United States Patent [19]

Dehne

[11] Patent Number: 4,464,997

[45] Date of Patent: Aug. 14, 1984

[54] CONVEYOR TROLLEY AND TRACK

[75] Inventor: Clarence A. Dehne, Farmington Hills, Mich.

[73] Assignee: Jervis B. Webb Company, Farmington Hills, Mich.

[21] Appl. No.: 401,924

[22] Filed: Jul. 26, 1982

Related U.S. Application Data

[63] Continuation-in-part of Ser. No. 340,112, Jan. 18, 1982, abandoned.

[51] Int. Cl.[3] ..... B61B 10/00; B61B 13/12; B61F 9/00

[52] U.S. Cl. ..... 104/172 S; 104/94; 104/107; 105/155

[58] Field of Search ..... 104/94, 95, 107, 108, 104/109, 172 S, 172 BT; 105/155

[56] References Cited

U.S. PATENT DOCUMENTS

| | | | |
|---|---|---|---|
| 1,920,774 | 8/1933 | Webb | 105/155 |
| 2,043,357 | 6/1936 | Strauss | 104/94 |
| 3,229,645 | 1/1966 | Dehne | 104/172 S |
| 3,375,790 | 4/1968 | Bishop | 104/172 S |
| 3,418,948 | 12/1968 | Fromme et al. | 104/172 S |
| 3,869,989 | 3/1975 | Pickstone | 104/94 |
| 3,882,793 | 5/1975 | Wakabayashi | 104/172 S X |

FOREIGN PATENT DOCUMENTS

| | | | |
|---|---|---|---|
| 516865 | 9/1955 | Canada | 104/107 |
| 756365 | 4/1967 | Canada | 104/172 S |
| 1516520 | 1/1968 | France | 104/94 |
| 987097 | 3/1965 | United Kingdom | 104/94 |
| 1263299 | 2/1972 | United Kingdom | 104/172 BT |

*Primary Examiner*—Robert B. Reeves
*Assistant Examiner*—Howard Beltran
*Attorney, Agent, or Firm*—Joseph W. Farley

[57] ABSTRACT

A conveyor comprising a track formed by a pair of longitudinally extending track members providing a pair of transversely spaced supporting surfaces and a pair of transversely spaced guide surfaces; and a trolley having a body on which supporting wheels and guide rollers are rotatably mounted. The trolley body includes a shield member that is disposed adjacent to the guide rollers, extends radially outwardly of the periphery thereof, and overlaps the guide track surfaces engaged thereby. A socket, formed in the trolley body and having one end closed by the shield member, movably supports a driving dog which has a stem portion projecting into the socket and engaged therein by rollers and wear plates carried by the trolley body. The shield member is located above the trolley and forms a cover that protects the moving parts of the trolley from contamination and decreases the possibility of a foreign object becoming wedged between the guide rollers and guide track surfaces.

13 Claims, 6 Drawing Figures

CONVEYOR TROLLEY AND TRACK

This is a continuation-in-part of copending application Ser. No. 06/340,112, filed Jan. 18, 1982, now abandoned.

This invention relates to improvements in a conveyor trolley and track, particularly a trolley of the type having a body with pairs of wheels and guide rollers adapted to engage transversely spaced supporting and guide surfaces of a pair of longitudinally extending track members which form the conveyor track. Also, the improvements of the invention are directed to such a conveyor trolley having a driving dog movable between extended and retracted positions relative to the trolley body. Trolleys of this type are used, for example, for a load carrier of a power and free conveyor wherein a driven chain and pushers supported by a power track are employed to propel the carrier along the conveyor track.

The adverse conditions under which many power and free conveyors operate expose the conveyor trolleys to accelerated wear resulting from contamination by dirt, spray, etc., and also to damage by foreign objects or by intentional sabotage. This problem tends to become more severe in a power and free conveyor having the power track mounted under the conveyor track for the trolleys of the load carriers, since the conveyor track is frequently located below the working level and is therefore more exposed to any adverse condition.

The present invention provides a conveyor trolley whose operating components such as wheels and guide rollers are protected from the effects of such adverse conditions; and, in the case of a conveyor trolley whose operating components include a movable driving dog, the present invention provides further protection by enclosing the portion of the trolley within which the movable driving dog is mounted.

A conveyor of the invention comprises a track formed by a pair of longitudinally extending track members having a pair of transversely spaced supporting surfaces and a pair of transversely spaced guide surfaces; and a trolley including a body, longitudinally spaced pairs of wheels rotatably mounted on the body and adapted to engage the supporting track surfaces, a pair of longitudinally spaced guide rollers rotatably mounted on the body and adapted to engage the guide track surfaces, the axes of rotation of the guide rollers being perpendicular to the axes of rotation of the wheels, and wherein the body includes a shield member disposed adjacent to and outwardly of the guide rollers, the shield member extending transversely to the axes of the guide rollers and having edge portions which overlap the guide track surfaces engaged by the guide rollers.

Preferably, the edge portions of the shield member include a pair of side portions transversely spaced by a distance greater than the transverse spacing between the guide track surfaces, and a pair of end portions, each end portion being adjacent to one of the guide rollers and extending radially outwardly of the periphery thereof. Also preferably, the guide rollers are rotatably mounted on the shield member, and the shield member is formed integrally with the trolley body.

Another preferred feature is that the guide track surfaces are formed by a pair of guide flanges on the pair of track members, each guide flange extending from one of the track members outwardly beyond the guide rollers and in substantially parallel relation to the axes of rotation thereof. The side portions of the shield member overlap the outer ends of the guide flanges.

In a conveyor trolley of the invention having a movable driving dog, the trolley body is formed with a socket located longitudinally between the pairs of wheels and centered transversely of the trolley body, the socket extending substantially parallel to the axes of the guide rollers and having an open end and an opposite end closed by the shield member. The driving dog has a stem portion which extends inwardly of the socket from the open end thereof, and suitable structure supports the stem portion in the socket for movement therein between extended and retracted positions of the driving dog relative to the trolley body.

The supporting structure for the stem portion preferably comprises a pair of rollers mounted in the socket on axle members extending transversely through the socket and spaced apart longitudinally thereof, slots in the stem portion for engaging the rollers, and transversely spaced wear plates mounted on the axle members and slidably engaged by the stem portion.

Other features and advantages of the invention will appear from the description to follow of the embodiments thereof illustrated in the accompanying drawings, wherein.

Figure 1:
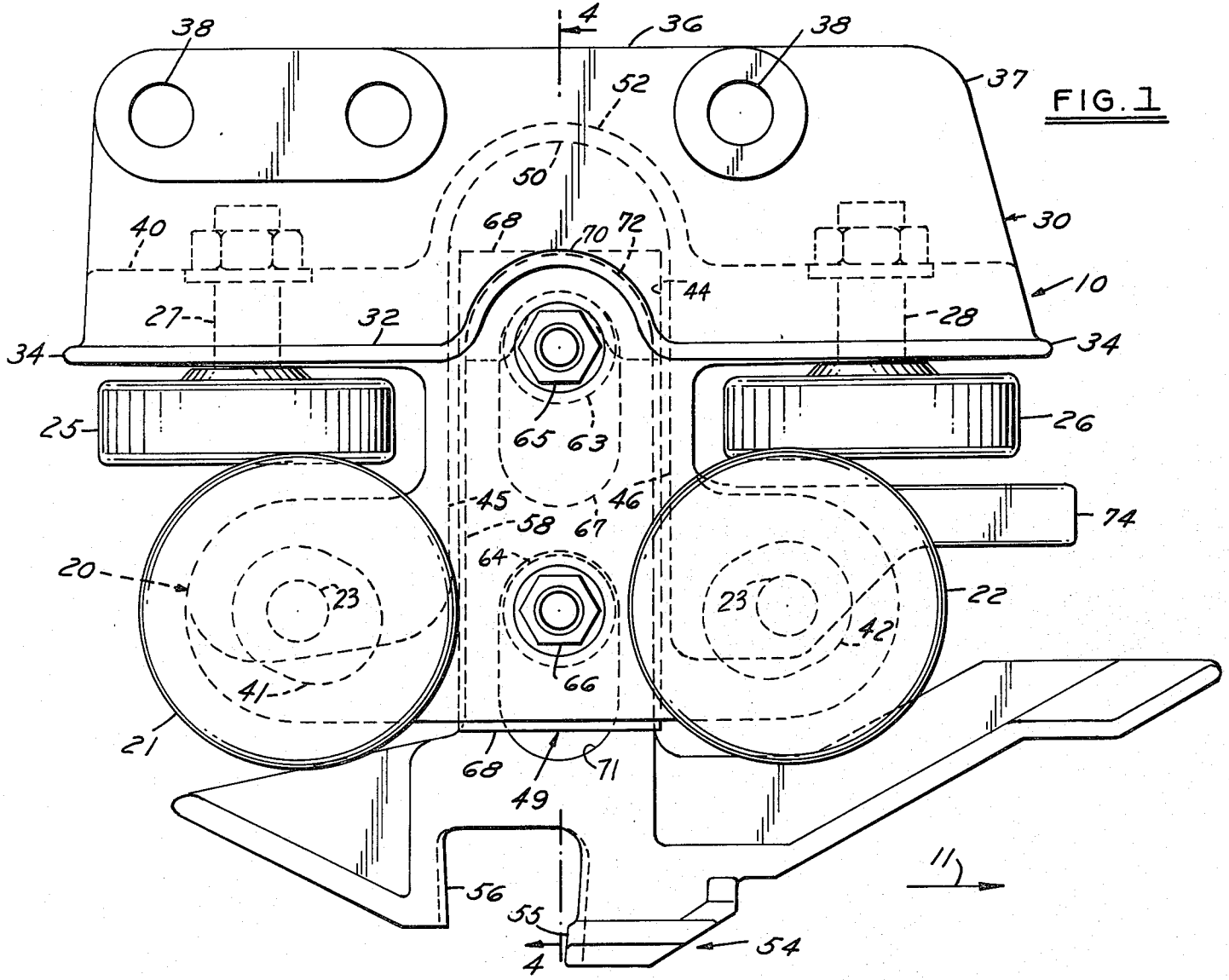
FIG. 1 is a side elevation of a conveyor trolley of the invention having a movable driving dog.

The trolley 10 illustrated in FIGS. 1-4 is a driving trolley for a load carrier of a power and free conveyor having a power track (not shown) mounted below the track 12 (FIGS. 2 and 3) on which the trolley 10 is adapted to travel in the direction indicated by the arrow 11 (FIG. 1). The track 12 is formed by a pair of longitudinally extending track members 13 and 14 having a pair of transversely spaced supporting surfaces 15 and 16 and a pair of transversely spaced guide surfaces 17 and 18.

Figure 2:
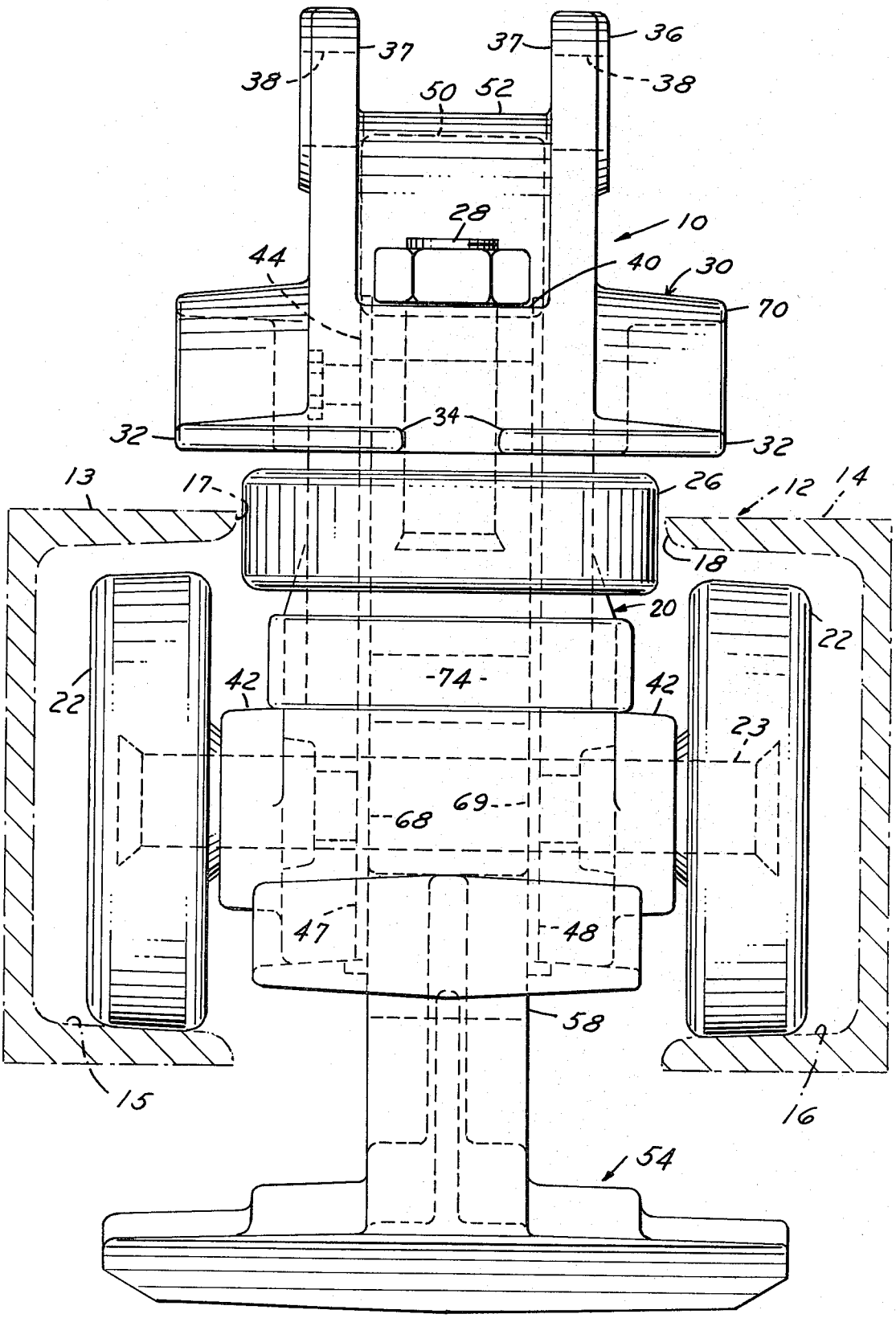
FIG. 2 is an enlarged transverse elevation taken from the right-hand side of FIG. 1 and includes a broken line showing a pair of track members.

The trolley 10 includes a body 20, longitudinally spaced wheels arranged in pairs 21 and 22 each pair being rotatably mounted on the body 20 by an axle 23 and being adapted to engage the supporting track surfaces 15 and 16, and a pair of longitudinally spaced guide rollers 25 and 26 rotatably mounted on the body on axles 27 and 28 and adapted to engage the guide track surfaces 17 and 18. As shown in FIGS. 1 and 2, the axes of rotation of the guide rollers 25 and 26 are perpendicular to the axes of rotation of the wheels 21 and 22.

Figure 3:
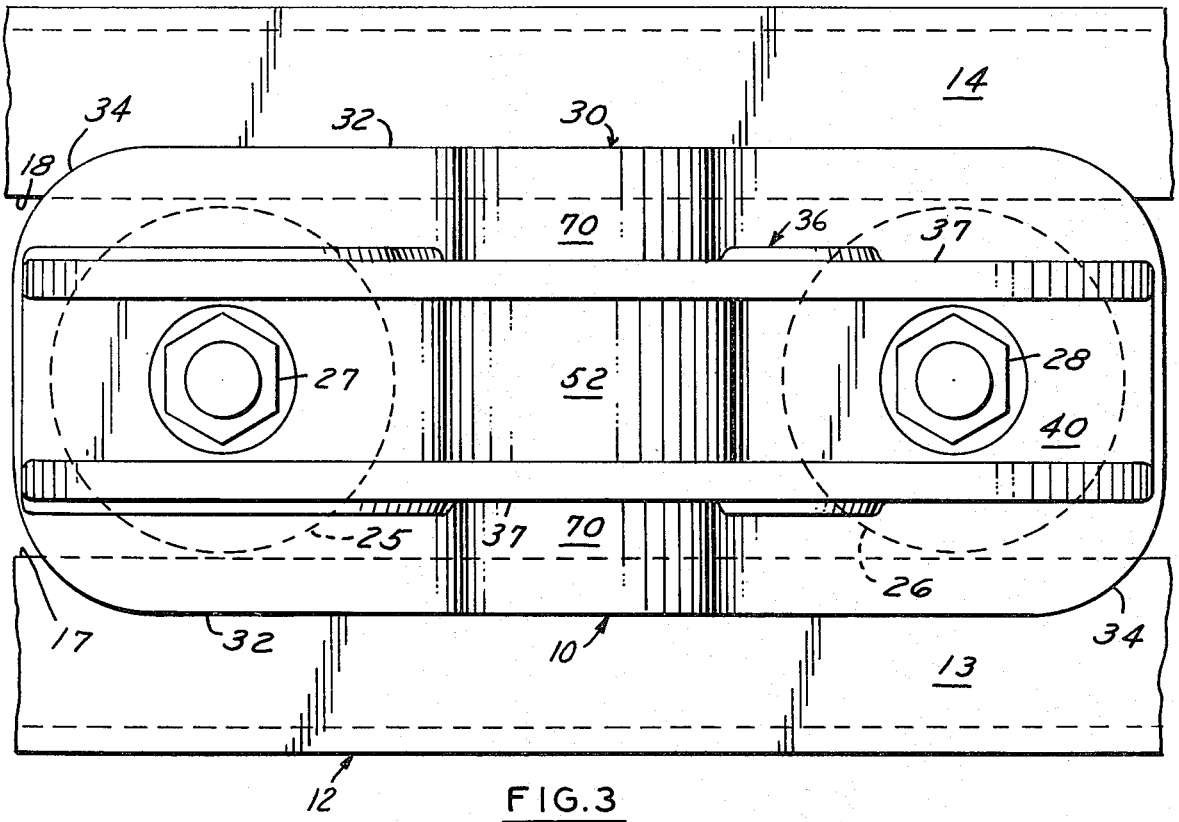
FIG. 3 is a top plan view of the trolley and track members of FIG. 2.

Included in the body 20 is a shield member 30 disposed outwardly of and adjacent to the guide rollers 25 and 26, and extending transversely to the axes thereof. As best shown in FIGS. 2 and 3, the shield member 30 has edge portions which project longitudinally and transversely beyond the peripheries of the guide rollers 25 and 26, and which are adapted to overlap the guide track surfaces 17 and 18 engaged by the guide rollers 25 and 26. The edge portions include a pair of side portions 32 transversely spaced by a distance greater than the transverse spacing between the guide track surfaces 17 and 18, and a pair of end portions 34 joining the side portions, each end portion 34 being adjacent to one of the guide rollers 25 and 26 and extending radially outwardly of the periphery thereof.

In the trolley construction illustrated, the shield member 30 is formed integrally with the trolley body 20 and integrally with an attachment portion 36 having accessory connecting structure formed by a pair of longitudinally extending transversely spaced ribs 37 provided with apertures 38 for securing load supporting or towing structure to the trolley 10. The guide roller axles 27 and 28 are mounted on a part 40 of the shield member 30 intermediate the ribs 37, as shown in FIGS. 2 and 3.

Figure 5:
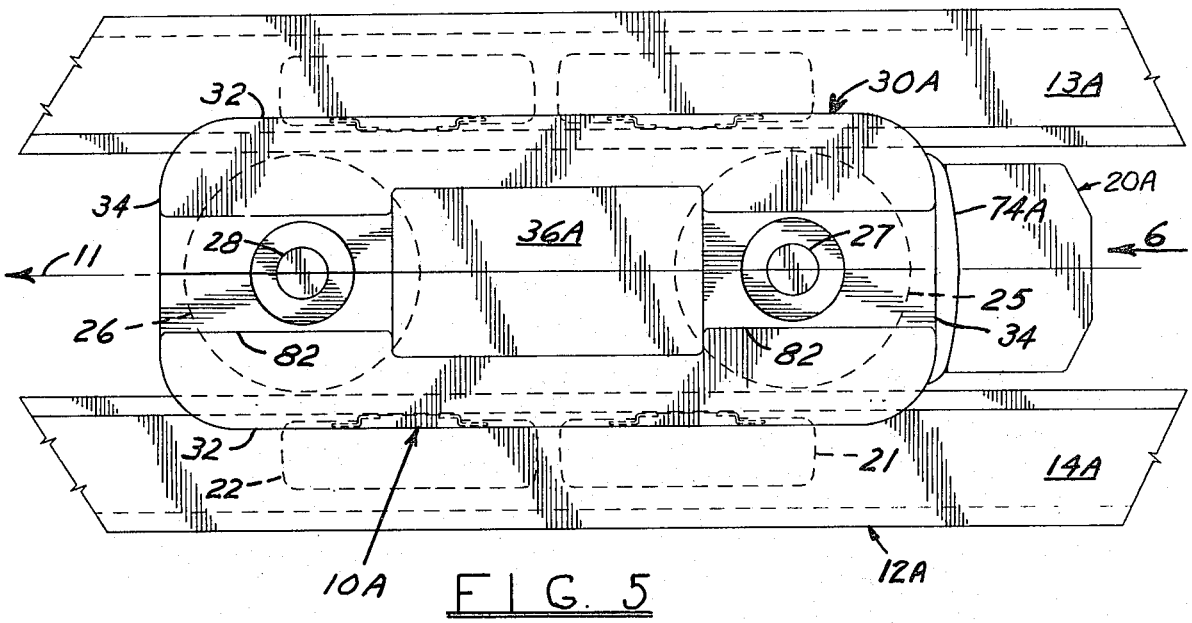
FIG. 5 is a top plan view similar to FIG. 3 showing a modified form of trolley and track members.
Figure 6:
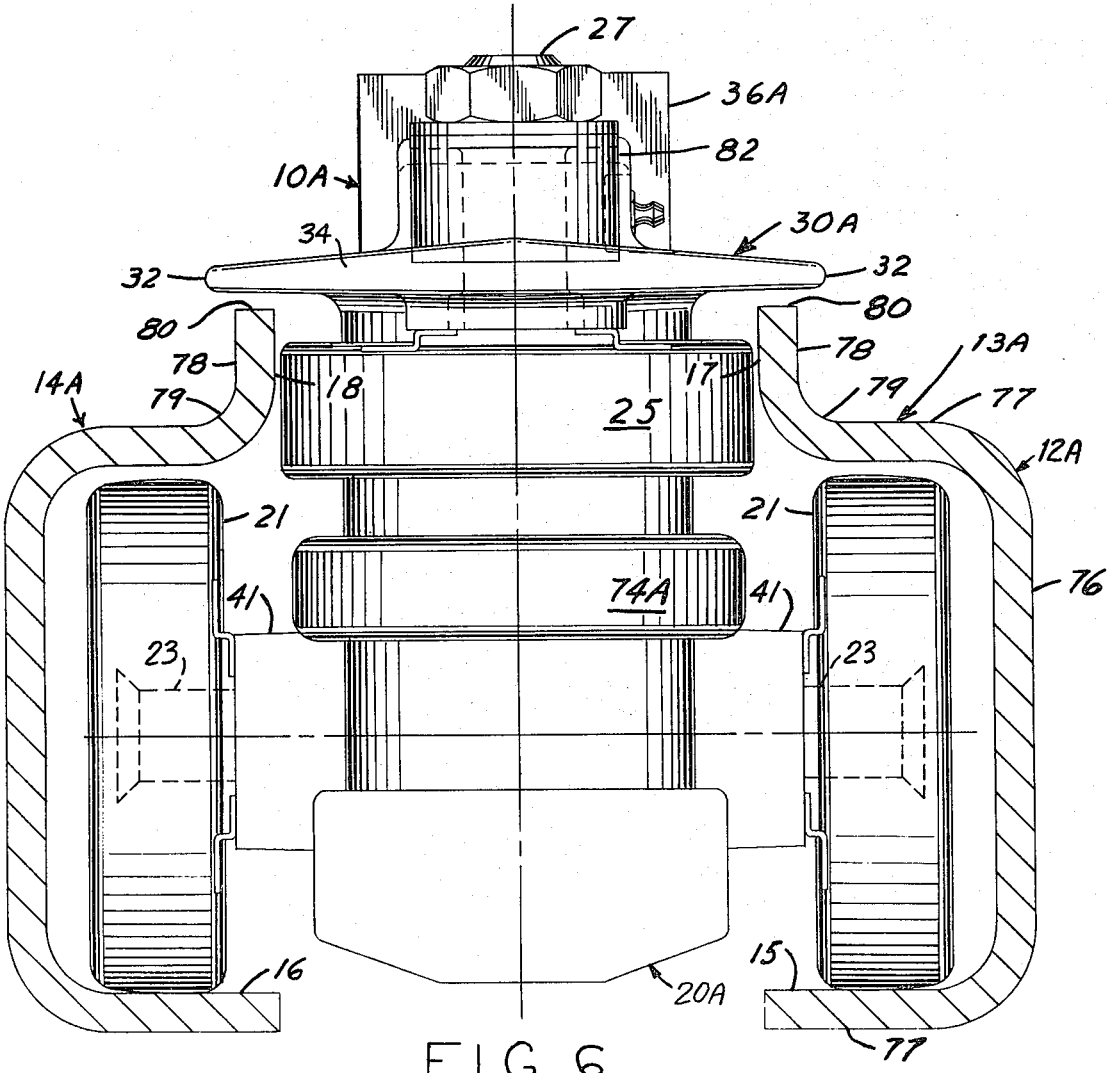
FIG. 6 is an enlarged transverse elevation taken as indicated by the arrow 6 of FIG. 5.

The modified form of trolley 10A and track members 13A and 14A shown in FIGS. 5 and 6 includes many parts corresponding to those described above and which are identified by the same reference number. Each of the track members 13A and 14A is integrally formed with a vertically extending web portion 76, a horizontal portion 77 at each end of the web portion 76 and a guide flange 78 extending vertically from one of the horizontal portions 77. The other horizontal portion 77 forms one of the supporting track surfaces 15 and 16 in the construction shown. However, it will be understood that either of the horizontal portions 77 can form a supporting track surface depending on whether the trolley 10A is used with its guide rollers 25 and 26 uppermost as shown, or lowermost as would be the case were the vertical orientation of the trolley and track members reversed.

Guide track surfaces 17 and 18 are formed by the guide flanges 78 each of which extends from one of the track members 13A and 14A outwardly beyond the guide rollers 25 and 26 and in substantially parallel relation to the axes of rotation thereof. The guide flanges 78 thus laterally enclose the guide rollers, provide greater contact area between the guide rollers and the track members, and reinforce the edge portions 79 of the track members.

The trolley 10A is adapted to be used as a load carrying or trailing trolley of a multiple-trolley load carrier of a power and free conveyor. Examples of such load carriers for overhead power and free conveyors may be found in U.S. Pat. Nos. 3,229,645 and 3,375,790 to which reference is made. Like the trolley 10 previously described, the trolley 10A has a shield member 30A (preferably also integrally formed with the trolley body 20A) which extends transversely to the axes of the guide rollers 25 and 26 and has edge portions including a pair of parallel side portions 32 and a pair of end portions 34 joining the side portions 32. The side portions 32 each overlap the outer end 80 of one of the guide flanges 78; each end portion 34 is adjacent to one of the guide rollers 25 and 26 and extends radially outwardly of the periphery thereof. Formed with the shield member 30A are bosses 82 which receive the guide roller axles 27 and 28 and an attachment portion 36A which is located longitudinally between the bosses 82 and is provided with apertures (not shown) for securing load supporting or towing structure to the trolley 10A.

Thus the shield member 30 of each of the trolleys 10 and 10A forms a protective cover that extends across the transverse space separating the track members into overlapping relation therewith, that extends over and beyond the guide rollers 25 and 26 and the guide track surfaces 17 and 18 engaged thereby, and that extends over boss portions 41 and 42 of the trolley body 20 to which the wheel axles 23 are attached. In addition to protecting all of these components of the trolley from contamination, the shield member 30 acts to decrease the possibility of a foreign object becoming pinched or wedged between the guide rollers 25 and 26 and the guide surfaces 17 and 18. When used with the track members 13A and 14A having the guide flanges 78, the shield member 30 and the flanges 78 decrease the likelihood of foreign objects getting inside of the track members. Other features of the shield member 30 relate particularly to the construction of the driving trolley 10 and will be described below.

Turning now to the driving features of the trolley 10, the trolley body 20 is formed with a socket 44 located longitudinally between the pairs of wheels 21 and 22 and centered transversely of the trolley body 20. The socket 44 extends substantially parallel to the axes of the guide rollers 25 and 26; is defined by transverse surfaces 45 and 46 (FIG. 1) and longitudinal surfaces 47 and 48 (FIGS. 2 and 4); and has an open end 49 and an upper, opposite end 50 closed by an arched web 52 of the shield member 30.

Figure 4:
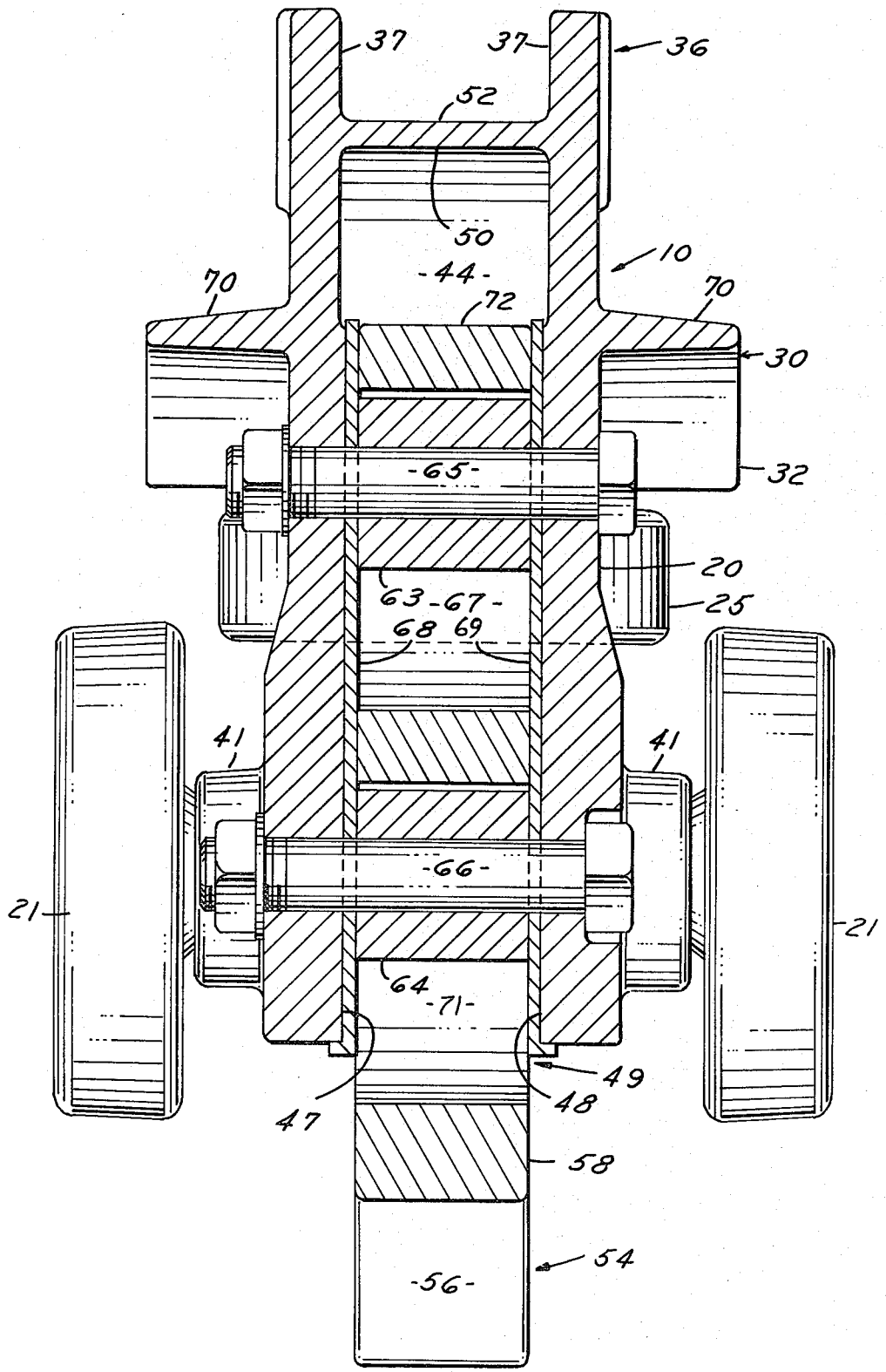
FIG. 4 is an enlarged transverse sectional elevation taken as indicated by the line 4-4 of FIG. 1.

A driving dog 54, provided with a driving face 55 and a holdback face 56 (FIG. 1) adapted to be engaged by a pusher (not shown), has a stem portion 58 which extends inwardly of the socket 44 from the open end 49 thereof. Supporting structure carried by the trolley body within the socket engage and support the stem portion in the socket for movement therein between extended and retracted positions of the driving dog 54 relative to the trolley body 20. In FIGS. 1, 2 and 4, the driving dog 54 is shown in its extended position, projecting from the open end 49 of the socket which faces the supporting track surfaces 15 and 16, and the driving dog is biased to this position by its mass.

The supporting structure illustrated comprises a pair of rollers 63 and 64 mounted in the socket 44 on axle members or bolts 65 and 66 which are spaced lengthwise of the socket, extend transversely of the trolley body 20 through the socket, and support the rollers 63 and 64 for rotation on axes substantially parallel to the axes of the trolley wheels 21 and 22. A pair of slots 67 and 71 is formed in the stem portion and is engaged by the rollers 63 and 64.

For a trolley body 20 formed integrally with the shield member 30, the supporting structure preferably also includes transversely spaced wear plates 68 and 69 mounted within the socket 44 on the axle members 65 and 66. The rollers 63 and 64 are located between the wear plates 68 and 69 which are slidably engageable by the stem portion 58 of the driving dog 54. This construction of the supporting structure makes it unnecessary to internally machine the socket 44.

Referring to FIG. 1, the side edge portions 32 of the shield member 30 adjacent to the socket 44 have an arch 70 for access to the axle member 65. Also, the end 72 of the stem portion 58 within the socket 44 has an arcuate shape conforming to the web 52 of the shield member 30 to permit full retracting movement of the driving dog 54. A bumper 74 formed on the trolley body 20 projects longitudinally beyond the shield member 30. This bumper projects forwardly and is adapted to engage a corresponding rearwardly projecting bumper provided on the next preceding trolley of a power and free conveyor, as illustrated by the bumper 74A on the trolley 10A of FIGS. 5 and 6.

What is claimed is:

1. In a conveyor trolley including a body, longitudinally separated pairs of transversely spaced supporting wheels and a pair of longitudinally spaced guide rollers rotatably mounted on the body, and a shield member formed on the body disposed outwardly of and adjacent to the guide rollers, the shield member extending perpendicular to the axes of the guide rollers and having portions which project longitudinally and transversely outwardly of the peripheries of the guide rollers; the improvement wherein:

the trolley body is formed with a socket located longitudinally between the pairs of wheels and centered transversely of the trolley body, the socket extending substantially parallel to the axes of the guide rollers and having an open end and an opposite end closed by the shield member;

a driving dog having a stem portion extending inwardly of the socket from the open end thereof;

and means supporting the stem portion in the socket for movement therein between extended and retracted positions of the driving dog relative to the trolley body.

2. A conveyor trolley according to claim 1 wherein the supporting means includes roller means carried by the trolley body within the socket for engagement by the stem portion of the driving dog.

3. A conveyor trolley according to claim 1 wherein the supporting means comprises at least one roller, an axle member extending transversely of the trolley body within the socket and supporting the roller for rotation on an axis substantially parallel to the axes of the trolley wheels, and slot means on the stem portion for engaging the roller.

4. A conveyor trolley according to claim 1, 2 or 3 wherein the socket includes wear plates slidably engageable by the stem portion of the driving dog.

5. A conveyor trolley according to claim 3 wherein transversely spaced wear plates are carried by the trolley body within the socket and are slidably engageable by the stem portion of the driving dog.

6. A conveyor trolley according to claim 5 wherein the wear plates are attached to the axle member.

7. A conveyor trolley according to claim 1 wherein the open end of the socket is directed toward the supporting track surfaces, and the driving dog is biased to the extended position by its mass.

8. A conveyor trolley according to claim 1 wherein the supporting means comprises a plurality of rollers, axle members spaced lengthwise of the socket and extending transversely of the trolley body through the socket, the axle members supporting the rollers for rotation on axes substantially parallel to the axes of the trolley wheels, and slot means on the stem portion for engaging the rollers.

9. A conveyor trolley according to claim 8 wherein transversely spaced wear plates are mounted within the socket on the axle members and are slidably engageable by the stem portion of the driving dog.

10. In a conveyor comprising a track formed by a pair of longitudinally extending track members having a pair of transversely spaced supporting surfaces; and a trolley having a body, longitudinally spaced pairs of wheels rotatably mounted on the body and adapted to engage the supporting track surfaces, and a driving dog carried by the body for movement between extended and retracted positions relative thereto; the improvement wherein:

the trolley body is provided with an integrally formed socket located longitudinally between the axes of the pairs of wheels and centered transversely of the trolley body, the socket extending substantially parallel to the axes of the guide rollers and having an open end and an opposite closed end;

the driving dog is formed with a stem portion extending inwardly of the socket from the open end thereof;

and means supporting the stem portion of the driving dog for movement lengthwise of the socket, the supporting means being carried by the trolley body and comprising wear plates spaced apart transversely of the socket and slidably engageable by the stem portion, and a plurality of rollers engageable by the stem portion, the rollers being mounted between the wear plates on axle members extending transversely of the socket and spaced apart lengthwise thereof.

11. A conveyor trolley according to claim 10 wherein the wear plates are attached to the axle members.

12. A conveyor trolley according to claim 10 or 11 wherein the open end of the socket is directed toward the supporting track surfaces and the driving dog is biased to the extended position by its mass.

13. A conveyor trolley according to claim 12 wherein the stem portion is provided with slot means for engagement by the rollers, the slot means and rollers defining the extended position of the driving dog.

* * * * *